US005122340A

United States Patent [19]

Shimamura et al.

[11] Patent Number: 5,122,340

[45] Date of Patent: * Jun. 16, 1992

[54] METHOD OF STERILIZING LAMINATED PACKAGING MATERIAL

[75] Inventors: Etsuo Shimamura, Goka; Sukenori Ito, Fuchu; Yuji Kawamura, Tokyo; Takuya Adachi, Koshigaya; Atsushi Yuzawa, Kasukabe; Masaaki Takada, Sugito, all of Japan

[73] Assignee: Toppan Printing Co., Ltd., Tokyo, Japan

[ * ] Notice: The portion of the term of this patent subsequent to Oct. 16, 2007 has been disclaimed.

[21] Appl. No.: 349,839

[22] Filed: May 10, 1989

[30] Foreign Application Priority Data

May 10, 1988 [JP] Japan ..... 63-113330
Sep. 14, 1988 [JP] Japan ..... 63-230492
Sep. 30, 1988 [JP] Japan ..... 63-246667

[51] Int. Cl.[5] ..... A61L 2/00
[52] U.S. Cl. ..... 422/28; 53/425
[58] Field of Search ..... 422/28, 302, 304; 53/426, 167, 425; 141/1, 63, 91, 92

[56] References Cited

U.S. PATENT DOCUMENTS 797,298 8/1905 Loew ..... 422/304
1,734,585 11/1929 Ladewig et al. ..... 422/304
3,336,722 8/1967 Van Der Winden ..... 422/303
3,575,713 4/1971 Duff et al. ..... 422/304
3,929,409 12/1975 Buchner et al. ..... 21/91
4,396,582 8/1983 Kodera ..... 422/31
4,409,188 10/1983 Silberzahn ..... 422/28
4,506,491 3/1985 Joosten et al. ..... 53/426
4,680,163 7/1987 Blidschun et al. ..... 422/28
4,683,701 8/1987 Rangwala et al. ..... 422/304
4,693,052 9/1987 Rebmann et al. ..... 422/304
4,888,155 12/1989 Posey et al. ..... 422/28
4,963,335 10/1990 Adachi et al. ..... 422/302

FOREIGN PATENT DOCUMENTS 0162968 12/1985 European Pat. Off. .
0261745 3/1988 European Pat. Off. .
0340790 11/1989 European Pat. Off. ..... 53/426
3515738C1 7/1986 Fed. Rep. of Germany .

*Primary Examiner*—Robert J. Warden
*Assistant Examiner*—T. A. Trembley
*Attorney, Agent, or Firm*—Bacon & Thomas

[57] ABSTRACT

A method for sterilizing a liquid packaging sleeve-like blank having two open ends and made of a laminated material including a paper layer, includes the steps of sterilizing the blanks by circulating a circulating unit holding a large number of blanks in a sterilizing tank which contains a sterilizing agent, to dip the blanks in the sterilizing agent, and removing the sterilizing agent by circulating another circulating unit holding the large number of blanks in a hot air drying tank in which hot air is blowed, to dry the blanks.

9 Claims, 9 Drawing Sheets

METHOD OF STERILIZING LAMINATED PACKAGING MATERIAL

BACKGROUND OF THE INVENTION

1. Field of the Invention

The present invention relates to a method for sterilizing laminated packaging material for forming a packing container to preserve a liquid such as juice or milk contained therein for a long period of time. More particularly, the present invention relates to a method for sterilizing a packaging material obtained by forming an elongated hollow packaging material including a paper layer therein into a sleeve having a predetermined length.

2. Description of the Related Art

There are two conventional methods for sterilizing packing containers.

According to the first conventional method, a sheet-like continuous laminated packaging material including a paper layer is sterilized with a hydrogen peroxide ($H_2O_2$) solution, and the hydrogen peroxide solution is dried and removed with hot air or the like. The sheet-like packaging material sterilized by this method is formed into a tube, and one end of the tube is then sealed. A predetermined liquid is poured in the tube, and a portion below the liquid surface is sealed. The resultant packaging material containing the liquid therein is cut at predetermined positions, thereby obtaining individual containers each containing the liquid.

According to the second conventional method, a sterilized laminated continuous packaging material is cut into blanks each having a predetermined length. A container having an opening and a predetermined shape is formed from each blank. A hydrogen peroxide solution is sprayed inside the container to sterilize its inner surface. The container is heated and dried with hot air to remove the hydrogen peroxide solution. A liquid is then poured in the container, and the container is sealed, thereby finishing a container filled with a liquid.

According to the first conventional method, it is easy to sterilize the packaging material. In addition, sterilization, drying, filling of a liquid, sealing below the liquid surface, and cutting are performed in the order to seal the liquid in the container. Even if a packaging material is a laminated material including a paper layer, the liquid contained in the container is not adversely affected by cut end faces and paper dust produced by cutting. In addition, there is no head space for air left inside the container and collected at the top portion of the container. Therefore, the first conventional method is advantageous in long-term preservation. Furthermore, the first conventional method is advantageous in that no hydrogen peroxide is left at a folded portion since the sealed packaging material is folded at predetermined positions to form individual containers.

The shape of the packing containers manufactured by the first conventional method is limited to a brick-like shape since the liquid is poured in the tube-like packaging material and the packaging material is sealed and formed into a predetermined shape. Since the individual containers are obtained after the liquid is sealed in the tube-like container material, the packaging material must be flexible. Therefore, it is difficult to form the packing container by a rigid material. For this reason, when a large amount of liquid is filled in a large packaging material, each individual container is deformed by the weight of the liquid. Therefore, the first conventional method is not suitable for manufacturing large containers.

Since each individual container is formed by sealing the packaging material below the surface of liquid contained in the packaging material, a head space which is disadvantageous in food preservation can be eliminated. However, there is a fear for spilling of the contained liquid at the time of opening the container. When the container is used for a liquid containing a solid substance such as juice or soup, the solid substance may be trapped at the sealed portion, thus causing incomplete sealing.

According to the second conventional method, a container having a predetermined length is sterilized and then a liquid is filled therein. Even if a liquid containing a solid substance is filled therein, there is no fear of trapping of the solid substance at the sealing portion. In addition, a head space is assured, and the liquid is not split when the container is opened.

According to the second conventional method, however, since the elongated continuous packaging material is cut into blanks each having a predetermined length and a container is formed from each blank, paper dust is produced during cutting of the packaging material into the blanks. In addition, nonsterilized end faces are formed. During formation of an empty container by folding the packaging material, the paper dust may be trapped at the folded portion. In addition, the nonsterilized end face is exposed inside the container at the folded portion. For this reason, it is difficult to maintain the packing container in a perfect aseptic state. The packing container sterilized by the second conventional method is not suitable for preserving the liquid for a long period of time.

In a columnar container formed from a rectangular blank and having a gable-like upper portion and a flat bottom portion, cut end faces are not exposed inside the container. For this purpose, one edge of the blank is bent outward, and the folded portion is sealed on the inner surface of the other edge. In this container, a step is formed on the inner surface, and the hydrogen peroxide solution serving as a sterilizing agent tends to be left at the step portion.

SUMMARY OF THE INVENTION

It is an object of the present invention to provide a method of sterilizing a packaging material formed such that a laminated packaging material including a paper layer is cut into blanks each having a predetermined length, each blank is bent to form an empty container, a liquid is filled in the empty container, and the container with the liquid is sealed.

It is another object of the present invention to provide a method of sterilizing a sleeve-like packing material, which is free from a danger caused by a residual sterilizing agent.

In order to achieve the above objects of the present invention, there is provided a method for sterilizing a liquid packing sleeve-like blank having two open ends and made of a laminated material including a paper layer, which comprises the steps of sterilizating the blanks by circulating a circulating unit holding a large number of blanks in a sterilizing tank which contains a sterilizing agent, to dip the blanks in the sterilizing agent; and removing the sterilizing agent by circulating another circulating unit holding the large number of blanks in a hot air drying tank in which hot air is blowed, to dry the blanks.

According to the present invention, the blank is dipped in a sterilizing agent and then washed with aseptic water. The washed blank is dried to eliminate the sterilizing agent.

DETAILED DESCRIPTION OF THE PREFERRED EMBODIMENTS

Figure 1:
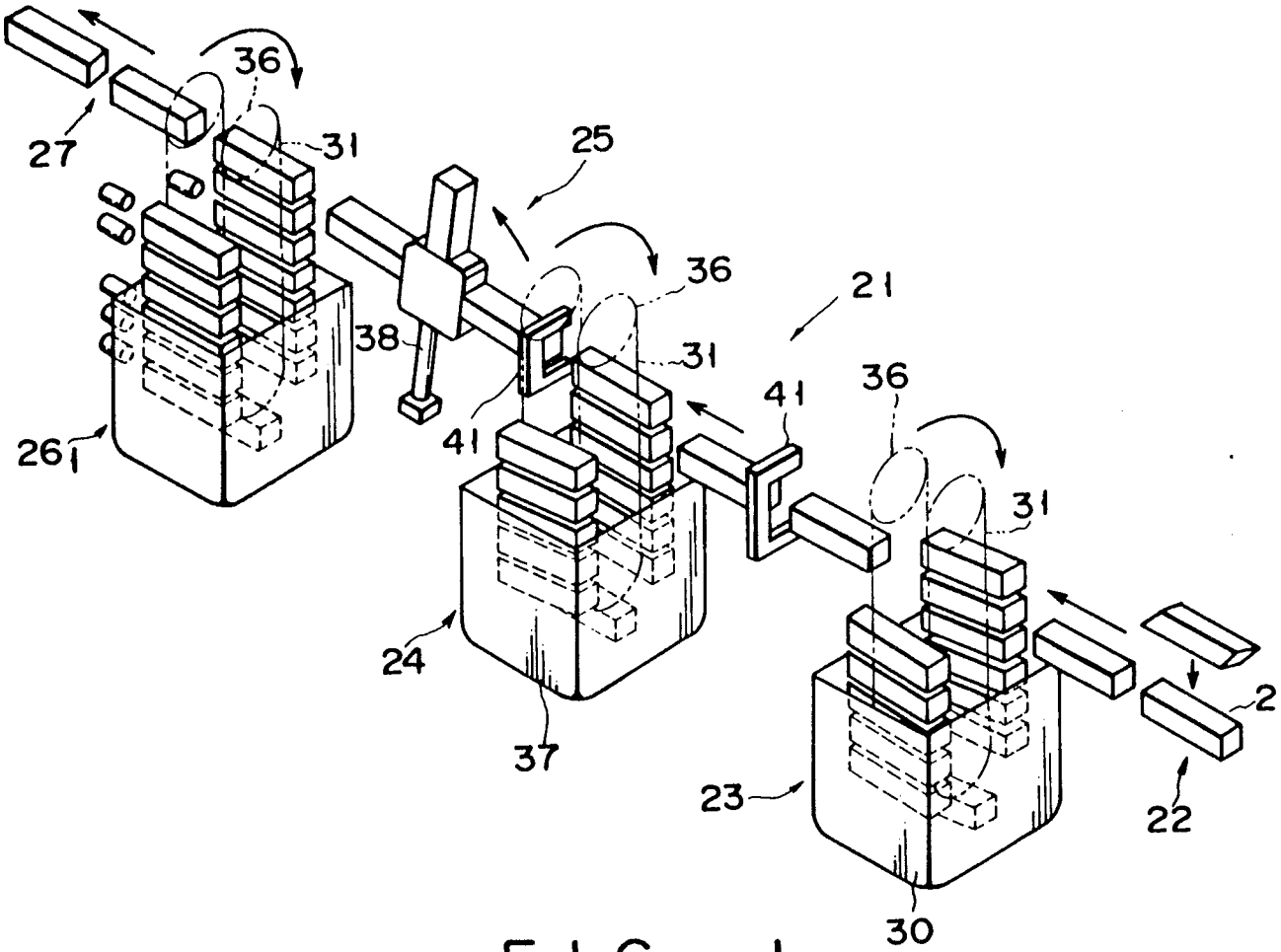
FIG. 1 is a perspective view showing the overall sterilizing apparatus used in a method of the present invention.
Figure 2:
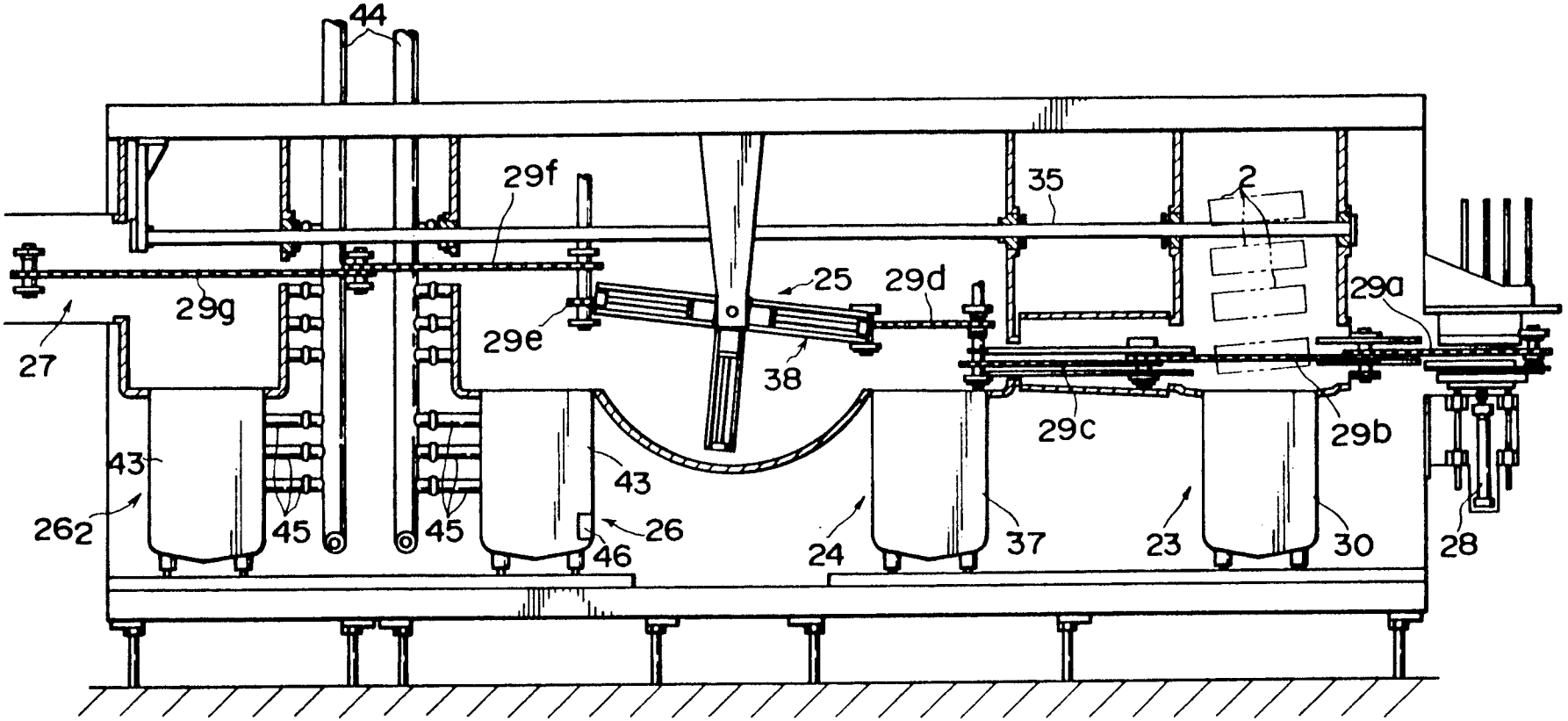
FIG. 2 is a sectional view showing an arrangement of the sterilizing apparatus shown in FIG. 1.
Figure 3A:
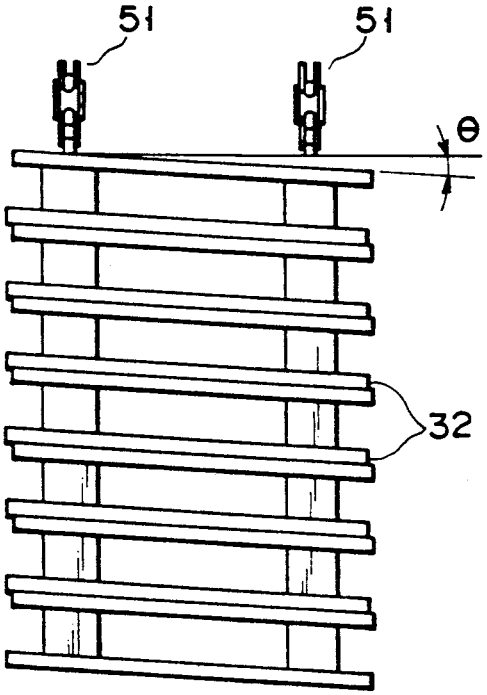
FIG. 3A is a front view showing a circulating unit for holding blanks.
Figure 3B:
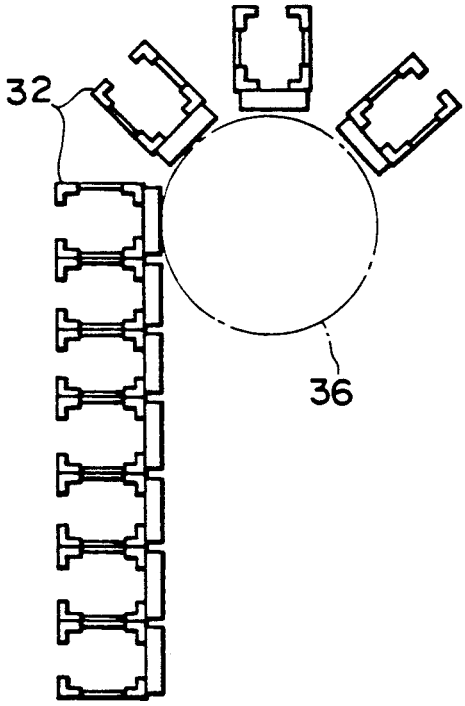
FIG. 3B is a side view of the unit shown in FIG. 3A.
Figure 7:
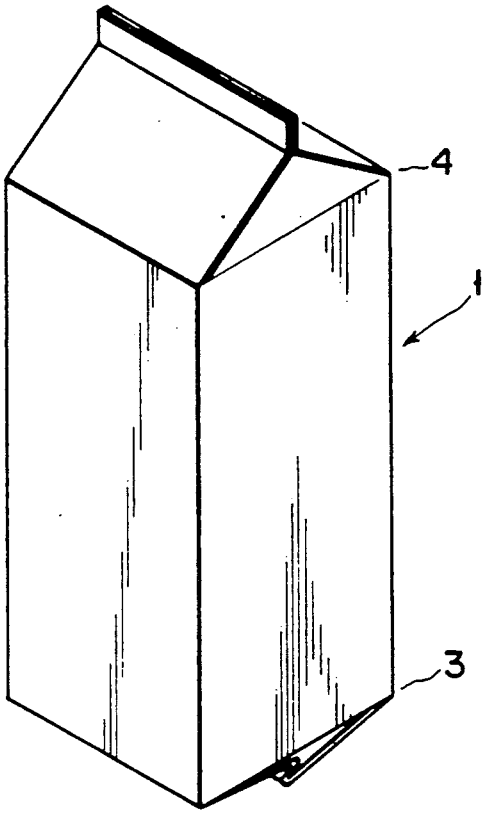
FIG. 7 is a perspective view showing a finished beverage container sterilized by the sterilizing apparatus.
Figure 8:
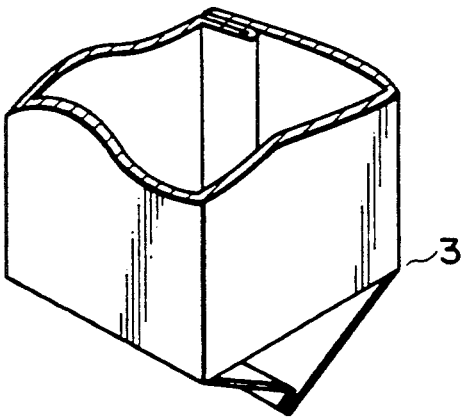
FIG. 8 is a perspective view showing a lower portion of the beverage container shown in FIG. 7.
Figure 9:
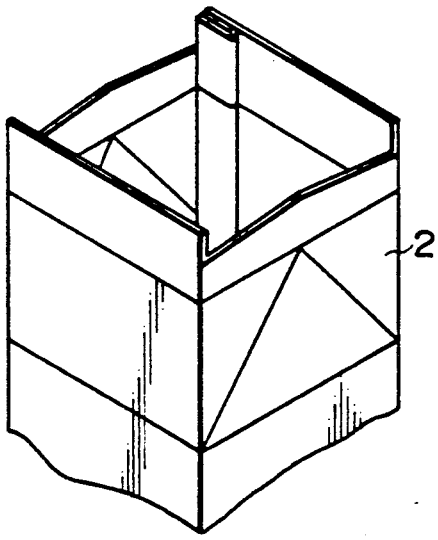
FIG. 9 is a perspective view showing an upper portion of the beverage container shown in FIG. 7.

FIGS. 1 and 2 show a sterilizing apparatus used in a sterilizing method according to an embodiment of the present invention. This sterilizing apparatus is used in an aseptic packing machine for packing a gable top container 1 shown in FIG. 7.

A sterilizing apparatus 21 is entirely housed in an aseptic chamber. Hollow columnar blanks 2 having two open ends are supplied from a supply station 22 located on the right side in FIG. 1. Each blank 2 is sterilized by a sterilizing station 23, washed in a washing station 24, and subjected to removal of the sterilizing agent in a sterilizing agent removal station 25, and dried by first and second hot air drying stations $\mathbf{26}_1$ and $\mathbf{26}_2$. The dried blank is transferred to the next process from a delivery station 27.

In the supply station 22, a large number of blanks 2 are folded flat and are stacked on an appropriate support. The flat blanks 2 are sequentially chucked by means of suction cups (not shown) and expanded into hollow columnar blanks. FIG. 2 shows an air cylinder 28 for operating these suction cups. Each hollow columnar blank 2 is fed to the sterilizing station 23 by a lateral feed chain **29*a*** having lateral grippers.

The sterilizing station 23 includes a sterilizing tank 30 which stores a 35 wt % hydrogen peroxide solution as a sterilizing solution heated to, e.g., about 80° C., and an endless circulating unit 31 which circulates the blanks 2 while holding them in the lateral direction.

Figure 4:
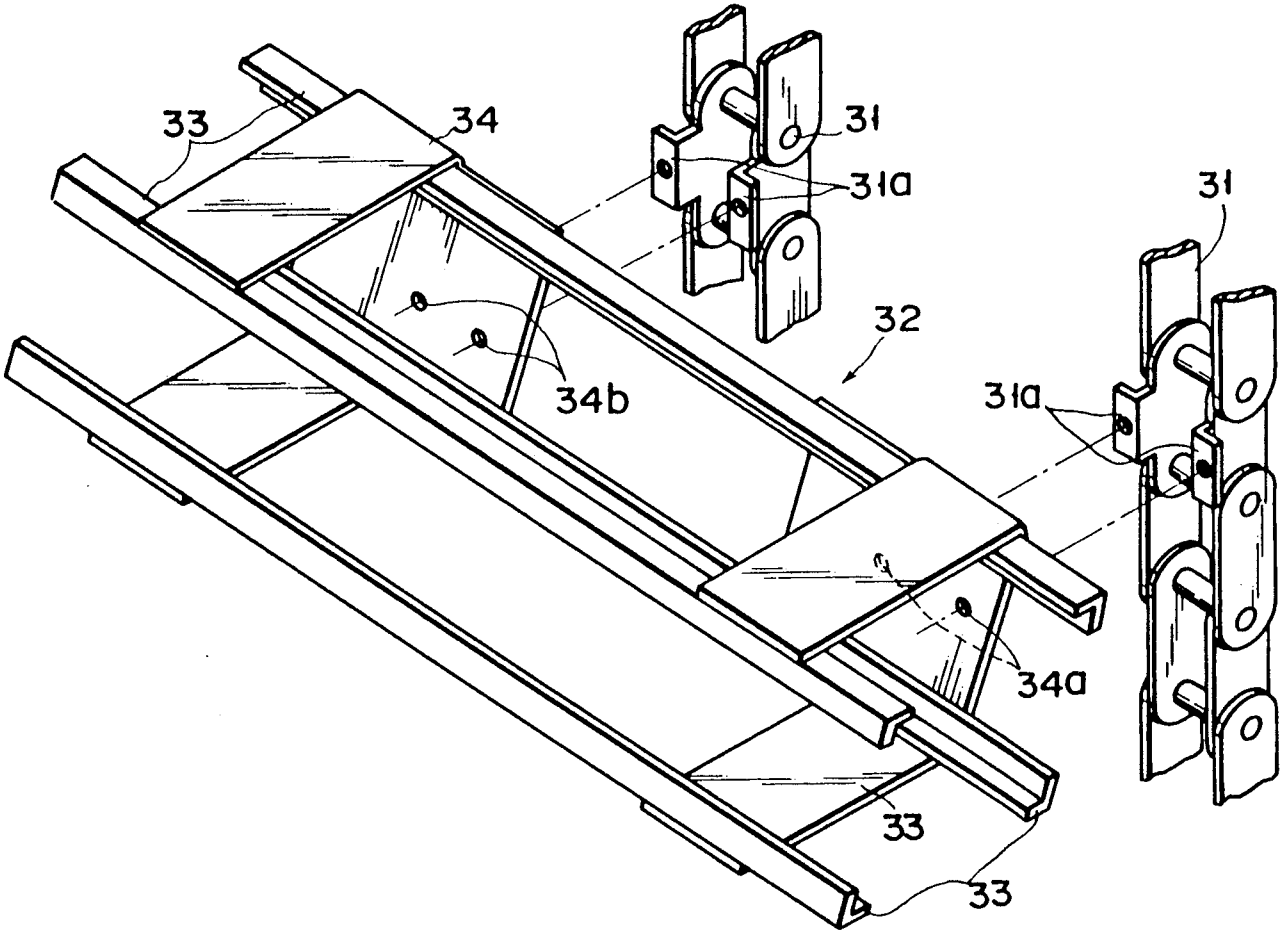
FIG. 4 is an exploded perspective view showing part of the circulating unit of the sterilizing apparatus shown in FIG. 1.
Figure 5:
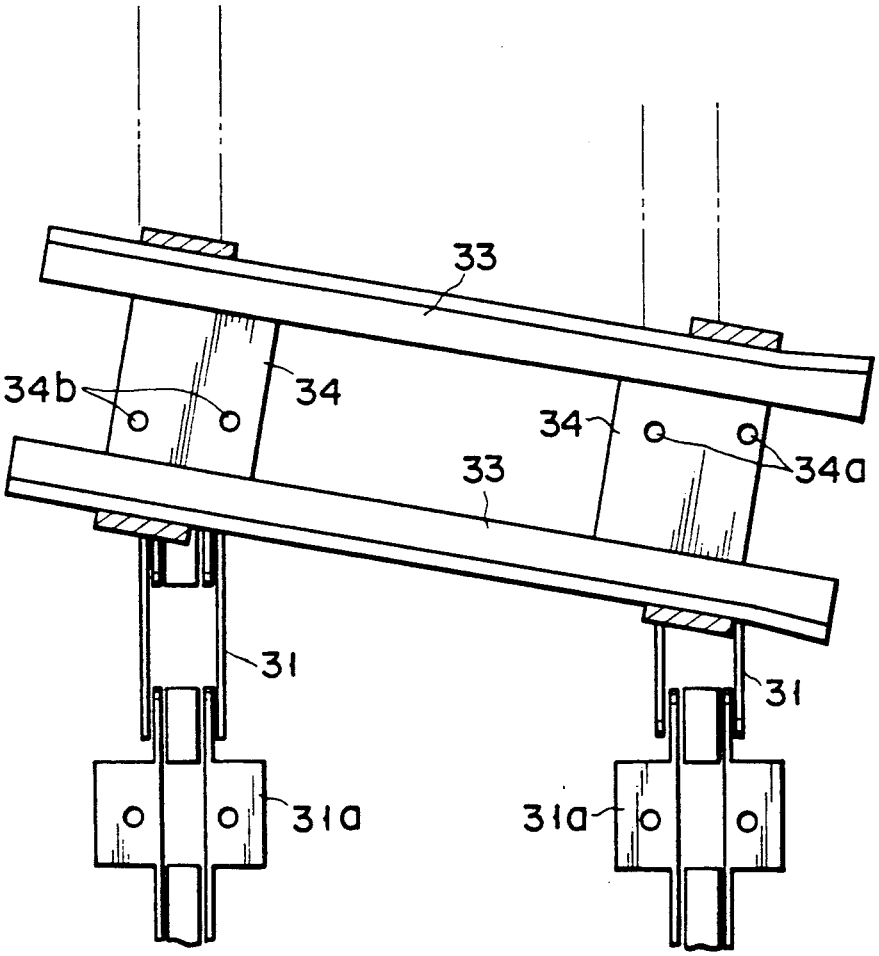
FIG. 5 is a side view showing part of FIG. 4.

The circulating unit 31 is best illustrated in FIGS. 3A, 3B, 4, and 5. For example, a plurality of link plates are coupled to form two parallel endless chains, and holding members 32 are attached to the outer travel surface of the chains through links **31*a*. Reference numerals 51 and 52 denote chains, respectively. The holding member 32 comprises four guide rails 33 each having an L-shaped section to guide edges of the blank 2 and a pair of brackets 34 for fixing the guide rails 33. Holes 34*a* and 34*b* formed in the pair of brackets 34 receive a fixing pin or a bolt (not shown) to fix the brackets to the links 31*a* of the chains. These holes 34*a* and 34*b* are formed to cause the holding member 32 to hold the bank 2 at an inclination angle of 2° to 5° with respect to the horizontal axis when the holding member 32 is fixed on the corresponding mounting links 31*a*. The guide rails 33 of the holding member 32 are flared at the right inlet portion, as shown in FIG. 4, so as to cause the lateral feed chain 29*a*** to smoothly feed the blank.

When the circulating unit 31 is intermittently rotated by appropriate drive sprockets 36 mounted on a drive shaft 35 arranged above the sterilizing tank 30 in a direction indicated by an arrow in FIG. 1, the blanks 2 are sequentially dipped in the sterilizing solution in the sterilizing tank 30 and sequentially removed therefrom. Since each blank 2 has two open ends and is dipped in the sterilizing solution while the blank 2 is inclined with respect to the horizontal axis, the sterilizing solution can perfectly reach the inner surface of the blank 2. Therefore, nonuniform sterilization upon attachment of bubbles or the like can be prevented. In addition, when the blank 2 is removed from the sterilizing solution, the sterilizing solution flows from the inside of the blank, and the sterilizing solution left inside the blank can be reduced.

The sterilized blanks 2 are fed to the washing station 24 by lateral feed chains **29*b* and 29*c* through the installed guide rails 33**.

A washing tank 37 which stores a washing solution is disposed in the washing station, as shown in FIGS. 1 and 2. When a circulating unit 31 for causing a holding member to hold each blank 2 in an inclined state in the same manner as in the sterilizing station 23 is intermittently rotated by the drive shaft 35 and sprockets 36, the blanks 2 are sequentially dipped in a washing solution in the washing tank 37 and are removed therefrom. The sterilizing solution attached to the surface of each blank 2 flows together with the washing solution.

Aseptic water filtered through an aseptic filter is stored in the washing tank 37 in a predetermined amount. This aseptic water may be heated to 60° C. to 80° C. to thoroughly remove the sterilizing solution.

The blanks 2 from which the sterilizing solution is washed in the washing station 24 is fed to the sterilizing agent removal station 25 through a lateral feed chain **29*d* while the circulating unit 31 is kept stopped. The height of the blank 2 at the inlet position of the washing station 24 is preferably changed from that at the outlet position of the washing station 24 to prevent the sterilizing agent from being mixed in the subsequent station. An aseptic water nozzle may be arranged to spray aseptic water to the lateral feed chain 29*d*** to wash off the sterilizing solution attached to the lateral feed chain, thereby minimizing entrance of the sterilizing solution into the subsequent station.

As shown in FIGS. 1 and 2, the sterilizing removal station 25, in illustrated embodiment, comprises four radial mandrels 38 at equal angular intervals. In this case, the blanks 2 are mounted on the four radial mandrels 38. The mandrels 38 are intermittently turned in synchronism with the operation of the circulating unit 31 of the washing station 24 along a plane parallel to a lower travel surface of the circulating unit 31. At a stop position, the mandrel 38 located nearest to the washing station 24 is inclined downward with respect to the horizontal plane. The distal end portion of this mandrel 38 is matched with the outlet of the washing station 24, thereby facilitating mounting of the blank 2.

Figure 6:
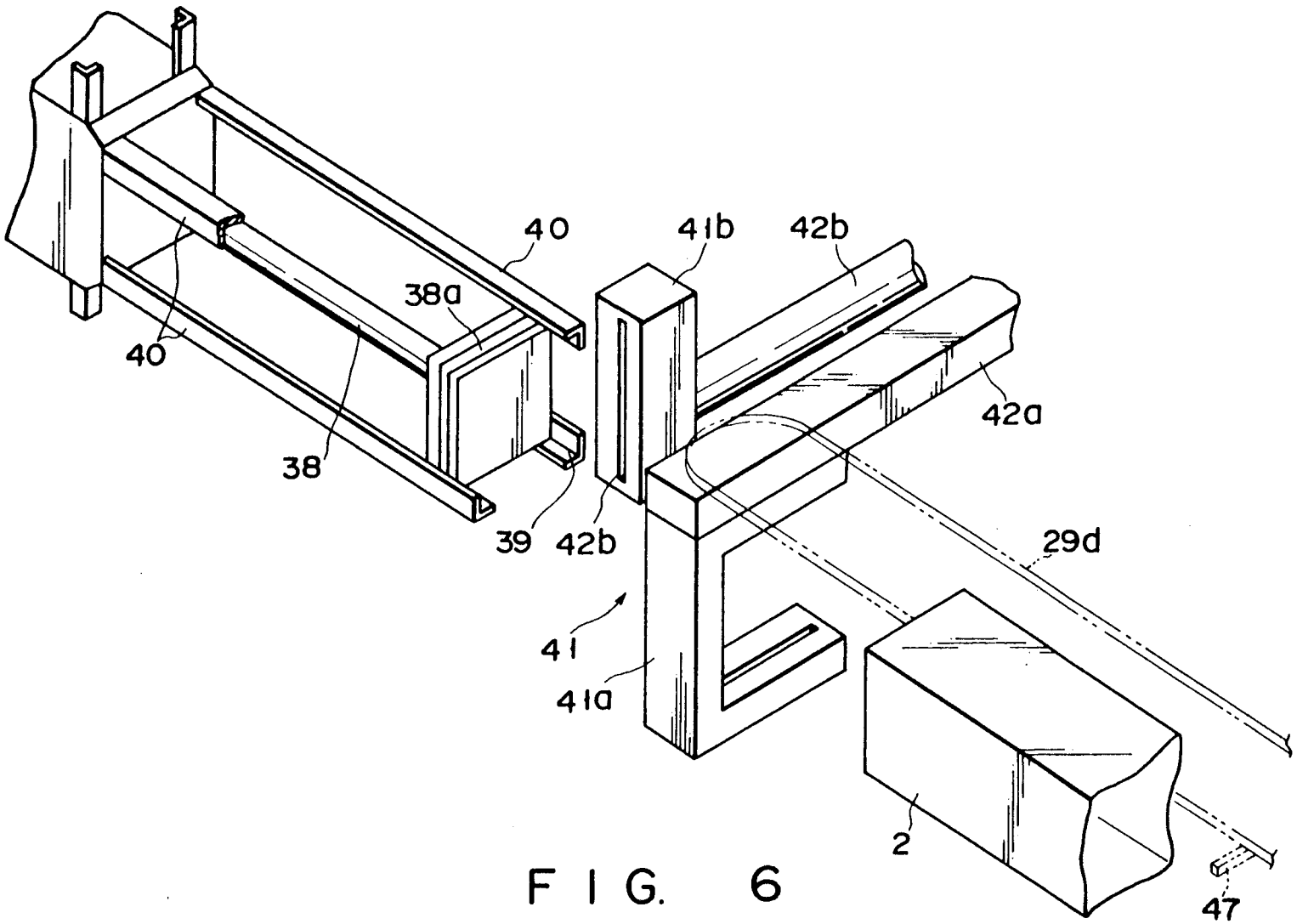
FIG. 6 is a perspective view showing the relationship between a washing station and a sterilizing agent removal station.

As best shown in FIG. 6, the mandrel 38 has a rectangular distal end 39. The blank 2 mounted from the distal end 39 is held by peripheral guide rails 40. An aseptic air nozzle 38*a* is continuously opened on the periphery of the distal end 39. Therefore, when the blank 2 gripped by grippers 41 of the lateral feed chain 29*d* is mounted on one of the mandrel 38, the sterilizing solution droplets are scattered from the inside of the blank 2 with air flushed from the aseptic air nozzle 38*a*.

In this embodiment, as shown in FIG. 1, nozzle units 41 having the same structure as described above are arranged between the sterilizing station 23 and the washing station 24 and between the washing station 24 and the sterilizing agent removal station 25 to flush the aseptic air to the outer surface of the blank 2, thereby removing the sterilizing solution from the outer surface of the blank 2.

The nozzle unit 41 comprises a C-shaped 3-side nozzle 41*a*, one side of which is open not to interfere movement of the lateral feed chain 29*d* and a rod-like one-side nozzle 41*b* located at a position corresponding to the opening of the C-shaped 3-side nozzle 41*a*, as shown in FIG. 6. These nozzles 41*a* and 41*b* are fixed at predetermined positions of the apparatus by supports 42*a* and 42*b*, respectively. Aseptic air is flushed from nozzle ports 42*a* and 42*b* continuously open in the inner surfaces of the nozzles 41*a* and 41*b*, so that the sterilizing solution is removed from the outer surface of the blank.

The sterilizing solution is removed from the outer surface of each blank 2 by means of the nozzle unit 41 and the inner surface thereof by means of the sterilizing agent removal station 25. The resultant blanks 2 are fed to the first hot air drying station $26_1$ by a lateral feed chain 29*e*. In the hot air drying station $26_1$, the blanks 2 are circulated in a hot air drying tank 43 by a circulating unit 31 having the same arrangement as those in the sterilizing station 23 and the washing station 24. Hot air supplied from air supply pipes 44 is blowed from one opening to the other opening of each blank 2 through hot air nozzles 45 arranged along a travel path of the circulating unit 31, thereby drying the blanks. A detector 46 is arranged in the drying tank 43 to detect an amount of hydrogen peroxide solution contained in the air in the tank. Whether the sterilizing solution is effectively remove in a path up to the sterilizing agent removal station 26 is determined by a detection signal from the detector 46. The circulating unit 31 may circulate within the drying tank 43 in the first hot air drying station $26_1$ such that the blanks 2 are held horizontally.

Each blank 2 blown with hot air from one opening to the other opening thereof in the first hot air drying station $26_1$ is fed to the second hot air drying station $26_2$ by a lateral feed chain 29*f*. The blanks 2 are moved by a circulating unit 31 in the same manner as in the first hot air dry station $26_1$. Hot air is blowed from the other opening to one opening of each bank 2, so that the blank is dried again.

The dried blanks 2 are then fed from the blank delivery station 27 to the next station by a lateral feed chain 25*g*.

The circulating units 31 in the sterilizing station 23, the washing station 24, and the drying stations $26_1$ and $26_2$ are intermittently driven by the drive shaft 35. The mandrels 38 of the sterilizing agent removal station 25 and the respective lateral feed chains are driven in synchronism with the operation of the drive shaft 35. Thus, transfer of the blanks 2 from one station to another station can be smoothly performed.

According to the sterilizing method of the above embodiment, the blanks 2 are entirely dipped in the $H_2O_2$ solution and perfectly sterilized. The sterilizing solution is washed off while the blanks are circulated in the washing tank 37. When the blanks are mounted on the mandrels 38 in an inclined state, the sterilizing solution left on the inner surfaces of the blanks 2 are scattered by air sprayed from the aseptic air flushed nozzle 38*a*. At the same time, aseptic air is flushed to the outer surface of each blank 2 by the nozzle unit 41 arranged between the washing station 24 and the sterilizing agent removal station 25. Therefore, the sterilizing solution attached to the inner and outer surfaces of the blanks 2 can be removed by the behavior of air and a gravitational effect. The blanks 2 can be inclined even in the sterilizing tank 30 or can be washed with hot water (washing water) of 60° C. to 80° C. after sterilization, thereby further enhancing the sterilization effect for the blanks 2. Since hot air is blowed from one opening to the other opening of each hollow blank 2 having two open ends in the hot air drying tank 43 in the first hot air drying station $26_1$ and is dried, and then hot air is blowed from the other opening to one opening of each blank 2 in the hot air drying tank 43 in the second drying station $26_2$ to dry it again, perfect drying with hot air can be achieved. The blanks 2 can be perfectly sterilized, and the sterilizing agent can be completely removed therefrom. For this reason, the resultant container is free from danger when a beverage is filled therein.

Blank samples each having a size of 70×70×300 mm were dipped in a 35 wt % $H_2O_2$ solution at 80° C. for 10 seconds. The sterilized blank samples were washed, subjected to sterilizing solution removal, and dried (15 seconds) in conditions shown in Table 1, and whether the concentration of residual $H_2O_2$ was reduced below 50 ppb as a target value was examined. Test results are shown in Table 1.

TABLE 1

| Sample | I (°C.) | II (%) | III (kfg/cm²) | IV (°C.) | V (°C.) | VI (°C.) |
|---|---|---|---|---|---|---|
| A | 28 | 0 | 5 | 150 | — | 1 |
| B | 40 | 0 | 5 | 150 | — | 2 |
| C | 60 | 0 | 5 | 150 | — | 0 |
| D | 80 | 0 | 5 | 150 | 150 | 0 |
| E | 80 | 0 | 5 | 150 | — | 0 |
| F | — | — | 5 | 150 | — | 8* |
| G | — | — | 5 | 150 | 150 | 5* |

Note:
I represents Temperature of Clearing Water;
II represent Initial $H_2O_2$ Concentration in Washing Water;
III represents Air Pressure in Mandrels;
IV represents First Drying Temperature;
V represent Second Drying Temperature;
VI represents Number of Samples Having Residual $H_2O_2$ concentration Exceeding 50 ppb.
Number of each sample is 16.
Air flushing time at the mandrels is 1.0 second.
*in column VI indicates that variations are found in detected residual concentration.

The sterilized blanks are conveyed in a forming/filling/sealing stations for performing forming filling, and sealing. In this process, the bottom portion of each blank is formed flat, ingredients are filled from the top of the blank, and the top portion is sealed, thereby obtaining a packing container.

According to the present invention, when an aseptic packing container is manufactured such that a laminated material including a paper layer is cut into blanks each having a predetermined length, a bottom portion of each blank is formed, and ingredients are filled in the blank, a continuous packaging material made of a laminated material including a paper layer is cut into sleeve-like blanks each having a predetermined length, and the blanks are dipped in the hydrogen peroxide. Therefore, paper dust produced during cutting can be removed. In addition, the end faces of each cut blank and a folded portion on its inner surface can be perfectly sterilized.

After sterilization, aseptic compressed air is flushed at least on the inner surface of each blank to remove the sterilizing solution, and therefore the sterilizing solution can be effectively removed.

Furthermore, the blank is dipped and sterilized in the sterilizing solution while the blank is inclined. Aseptic compressed air is flushed to each blank while it is inclined, thereby effectively removing the sterilizing solution after sterilization.

After each blank is sterilized in the sterilizing solution, it is dipped in aseptic water having a temperature of preferably 60° C. or more to wash off the sterilizing solution. The sterilizing solution which tends to be left in the folded portion on the inner surface of the blank can be perfectly removed.

Blank samples were dipped in a 35 wt % hydrogen peroxide solution having a temperature of 80° C. for 10 seconds. The sterilized blank samples were then washed and dried in the conditions shown in Table 2. A test of a washing effect was performed by changing the initial concentration of hydrogen peroxide in the washing water. The temperature of the washing water was 60° C., and the initial hydrogen peroxide concentrations of the washing water were changed among 0%, 0.5%, 1%, and 2%. Results are shown in Table 2.

TABLE 2

| Sample | IIa (%) | III (Kgf/cm2) | IV (°C.) | VI (N) |
|---|---|---|---|---|
| H | 0 | 5 | 150 | 0 |
| I | 0.5 | 5 | 150 | 0 |
| J | 1.0 | 5 | 150 | 0 |
| K | 1.5 | 5 | 150 | 2 |

Note
IIa represents $H_2O_2$ Concentration in Washing Water;
III, VI represent condition same as Table 1.
Number of each sample is 16.

As is apparent from the above results, even if the initial hydrogen peroxide concentration in the washing water is not 0%, a prescribed washing effect can be expected at a hydrogen peroxide concentration of less than 1.0%.

In order to set the hydrogen peroxide concentration in the washing water to be less than 1.0%, a means is preferably provided to circulate the washing water in the washing tank while applying ultraviolet ray to the washing water, or cause the washing water to overflow from the washing tank while washing water is kept supplied from a washing water source at a predetermined flow rate.

In order to reduce an increase in hydrogen peroxide concentration in the washing water, aseptic compressed air is preferably flushed to each blank to remove the hydrogen peroxide solution from its surface as much as possible before the blank is fed to the washing station.

It is also possible to add acetic acid and peracetic acid to the hydrogen peroxide solution used as a sterilizing solution. A typical composition of the mixture type sterilizing solution is as follows:

| Component | Content (% by weight) |
|---|---|
| Peracetic acid | 10 to 45 |
| Acetic acid | 40 to 85 |
| Hydrogen peroxide | 1 to 15 |
| Balance (water) | 1 to 15 |

The mixed sterilizing solution is diluted with water and used in a concentration of 0.1 to 10.0% at 10° to 90° C.

EXAMPLE

Sterilization was performed by using the apparatus shown in the drawing. In this experiment, the sterilization was applied to cartons having both surfaces implanted with $10^7$ spores of Bacillus subtilis var. golobigii [IFO 1372]. Tables A and B show the results:

TABLE 3

| Sterilizing Solution | Concentration (%) | Temperature (°C.) | No. of bacteria-detected cartons |
|---|---|---|---|
| $H_2O_2$ | 35 | 80 | 0 |
| Peracetic acid + $H_2O_2$ | 6 | 60 | 0 |
| Peracetic acid + $H_2O_2$ | " | 30 | 2 |
| Peracetic acid + $H_2O_2$ | 2 | 80 | 0 |
| Peracetic acid + $H_2O_2$ | " | 60 | 3 |

Note
The number of cartons used was 20 for each test

TABLE 4

(Result of Residue Analysis)

| Sample | I (°C.) | II (%) | III (kfg/cm²) | IV (°C.) | V (°C.) | VI (°C.) | VII (N) |
|---|---|---|---|---|---|---|---|
| A | 28 | 0 | 0 | 5 | 150 | | 3 |
| B | 40 | 0 | 0 | 5 | 150 | | 1 |
| C | 40 | 0 | 0 | 5 | 150 | 150 | 0 |
| D | 50 | 0 | 0 | 5 | 150 | | 0 |
| E | 60 | 0 | 0 | 5 | 150 | | 0 |
| F | — | — | — | 5 | 150 | | 6* |
| G | — | — | — | 5 | 150 | 150 | 5* |

Note
I represents Washing Water Temp. (°C.);
II represents Peracetic acid in washing water;
III represent $H_2O_2$ Conc. (%);
IV represents Mandrel air pressure;
V represents First Drying (°C.);
VI represent Second Drying (°C.);
VII represents No. of samples in which the residual peracetic acid and $H_2O_2$ exceeded 50 ppb.;
Air spurting . . 1.0 second
The number of samples . . . n = 16
*Variation was found A sterilizing apparatus shown in FIG. 10 will be described below. This sterilizing apparatus suitable for sterilizing a continuous sheet-like packaging material.

Figure 10:
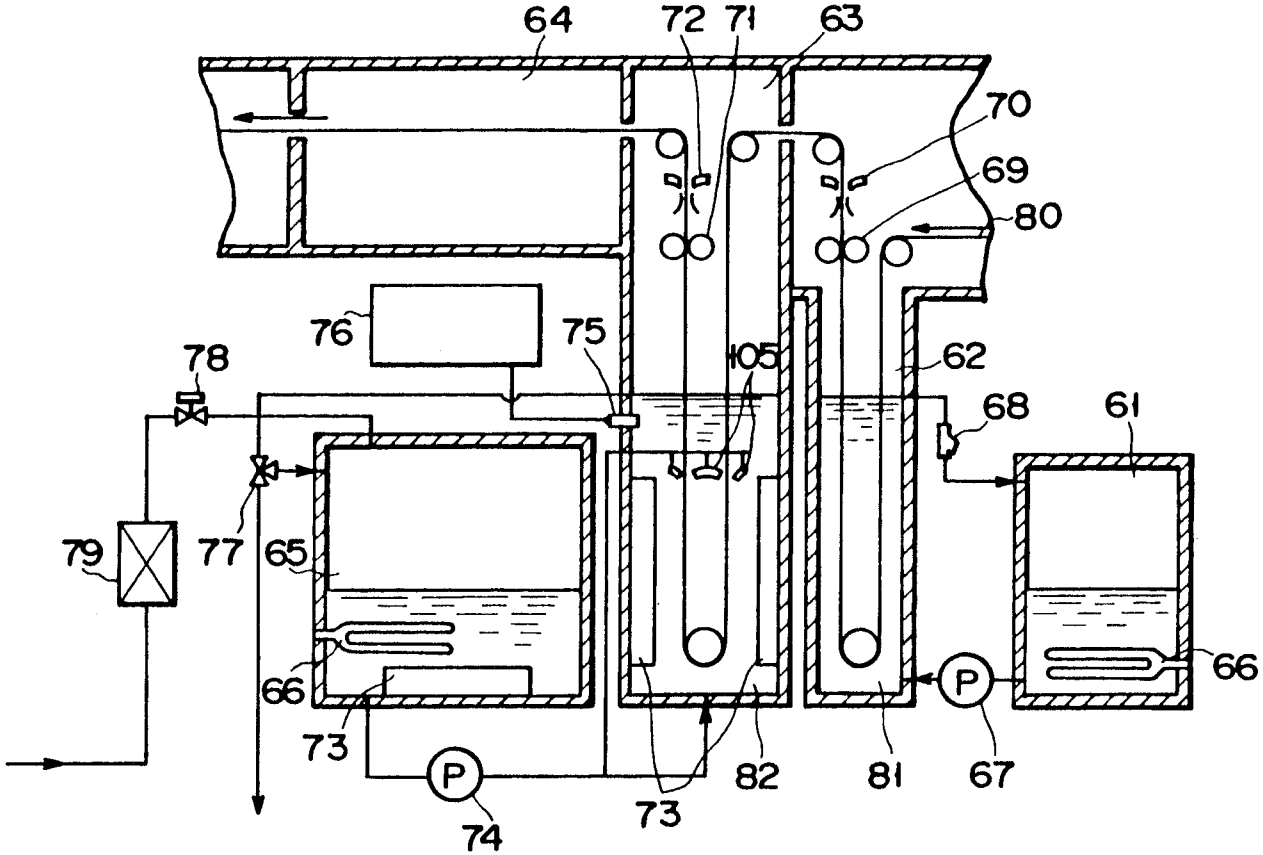
FIG. 10 is a sectional view showing a sterilizing apparatus suitable for continuously sterilizing packaging materials.

As shown in FIG. 10, a packaging material 80 supplied to the sterilizing apparatus is dipped in a sterilizing solution 81 in a sterilizing solution chamber 62 for sterilizing the packaging material. Sterilizing time is preferably sufficient sterilization time, e.g., about 10 seconds. The sterilizing solution is removed from the surfaces of the packaging material 80 passing through the sterilizing solution 81 by a sterilizing agent removal unit consisting of first press rollers 69 and air knives 70.

The sterilizing solution heated to about 70° to 80° C. by a heater 66 in a sterilizing solution tank 61 is supplied to the sterilizing solution chamber 62 by a feed pump 67. A return path is open in the sterilizing solution chamber 62 at its predetermined position through a filter 68 for impurity removal to maintain a constant sterilizing solution level in the sterilizing solution chamber 62. This return path communicates with the sterilizing solution tank 61. Therefore, the sterilizing solution kept almost at a constant temperature is kept in a constant amount in the sterilizing solution chamber 62.

The sterilizing solution is removed from the packaging material 80 which has passed through the sterilizing solution by the first press rollers 69 located above the sterilizing solution 81 in the sterilizing chamber and the first air knives 70 for blowing aseptic air to the surfaces of the packaging material.

The packaging material 80 which has passed through the sterilizing solution chamber 62 is supplied to an aseptic water chamber 63.

Aseptic water 82 is stored in the aseptic water chamber 63. In addition, aseptic water spray nozzles 105 are arranged in the upper portion of the aseptic water within the aseptic water chamber 63. The aseptic water spray nozzles 105 are used to perfectly remove the sterilizing solution attached to the packaging material when removal of the sterilizing agent by the first press rollers 69 and the first air knives 70 is incomplete.

Aseptic water 82 in the aseptic water chamber 63 is supplied from an aseptic water tank 65 through a pump 64. Another heater 66 is arranged in the aseptic water tank 65. Aseptic water heated to a predetermined temperature is supplied by a feed pump 74. In order to maintain a constant water level in the aseptic water chamber 63, a return path is open at a predetermined position in the aseptic water chamber 63. The return path communicates with the aseptic water tank 65 through a three-way valve 77. Therefore, the aseptic water having almost a constant temperature is maintained in the aseptic water chamber 63 in a predetermined amount. A supply path is connected to the aseptic water tank 65 through an aseptic water regenerating filter 79. Supply of aseptic water to the aseptic water tank 65 is controlled by a control valve 78.

A pair of ultraviolet lamps 13 are arranged in the aseptic water chamber 63 to decompose the sterilizing solution attached to the packaging material 80 in the aseptic water chamber 63. The sterilizing solution introduced during a normal operation can be decomposed by the lamps 13.

Units 75 and 76 for measuring sterilizing solution concentrations in aseptic water are mounted below the aseptic water level in the aseptic water chamber 63. When removal of the sterilizing solution from the surfaces of the packaging material 80 cannot be performed due to the failure of the first press rollers 69 and the first air knives 70 or any other cause, and the sterilizing solution concentration in the aseptic water 82 is abnormally increased, this state is detected by the sterilizing solution concentration measuring units 75 and 76. An abnormal detection result is signaled to an operator, and the operator switches the three-way valve 77 to discharge water. Therefore, circulation of aseptic water containing a sterilizing solution in a concentration exceeding an allowable level to the aseptic water tank 65 can be prevented. In this case, aseptic water of the same amount as that of discharged aseptic water is supplied to the aseptic water tank 65 through the control valve 78.

The packaging material 80 from which the sterilizing agent is washed off with the washing water in the washing chamber is removed from the washing water. The aseptic water attached to the packaging material is removed by an aseptic water removal unit consisting of second press rollers 71 and second air knives 72.

The packaging material 80 is then fed to a drying chamber 64 and then the next filling/forming station.

Figure 11:
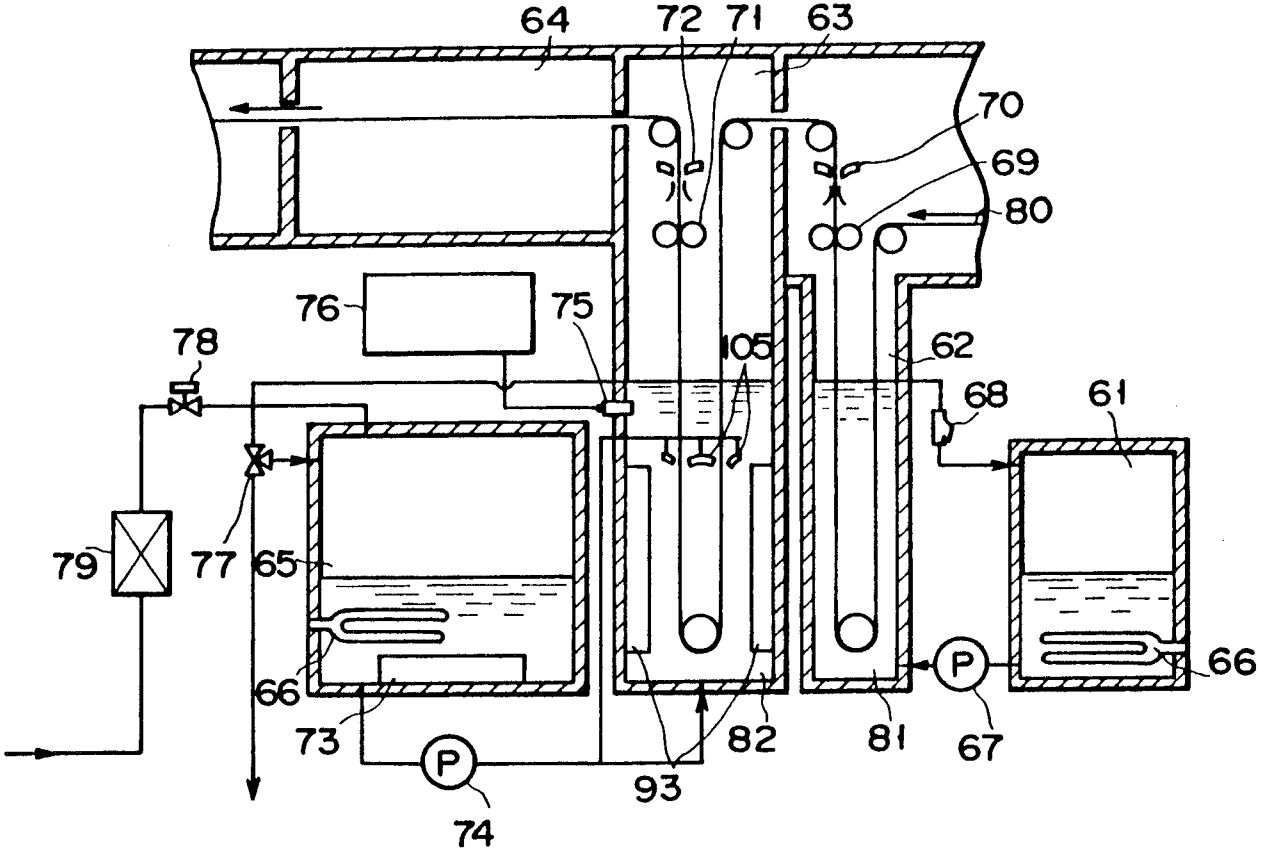
FIG. 11 is a sectional view showing a modification of the sterilizing apparatus shown in FIG. 10.

FIG. 11 shows a modification of the sterilizing apparatus of FIG. 10. The same reference numerals as in FIG. 10 denote the same parts in FIG. 11, and a detailed description thereof will be omitted.

The apparatus in FIG. 11 is substantially the same as that of FIG. 10 except that ultrasonic oscillation units 93 are arranged in place of the ultraviolet lamps in an aseptic water chamber 63. The ultrasonic oscillation units 93 can effectively remove the sterilizing solution from the packaging material.

The present invention has been described with reference to particular embodiments. However, the present invention is not limited to these. Various changes and modifications may be made within the spirit and scope of the invention.

What is claimed is:

1. A method for sterilizing liquid packaging blanks, comprising the steps of:

providing liquid packaging blanks which are made of a laminated material including a paper layer, and each of which has two open ends and an axis;

sterilizing the blanks by dipping the liquid packaging blanks sequentially in a sterilizing agent while inclining the axes of the liquid packaging blanks with respect to a horizontal plane;

removing the sterilizing agent from the liquid packaging blanks by blowing sterilized and compressed air at the liquid packaging blanks; and drying each of said blanks by blowing hot air at the liquid packaging blanks at least in one direction along the axes thereof.

2. A method according to claim 1, wherein the sterilizing agent is a hydrogen peroxide solution.

3. A method according to claim 1, wherein the sterilizing agent is a mixture having hydrogen peroxide and acetic acid.

4. A method for sterilizing liquid packaging blanks, comprising the steps of:

providing liquid packaging blanks which are made of a laminated material including a paper layer, and each of which has two open ends and an axis;

sterilizing the blanks by dipping the liquid packaging blanks sequentially in a sterilizing agent while inclining the axes of the liquid packaging blanks with respect to a horizontal plane;

washing off the sterilizing agent attached to the liquid packaging blanks by dipping each of the liquid packaging blanks in a washing solution;

removing the washing solution by blowing sterilized and compressed air at the washed liquid packaging blanks, and drying each of said liquid packaging blanks and further removing the sterilizing agent by blowing hot air at the liquid packaging blanks.

5. A method according to claim 4, wherein the blanks are inclined with respect to a horizontal plane when the liquid package blanks are dipped in the washing solution.

6. A method according to claim 5, wherein the sterilizing agent contains a hydrogen peroxide solution.

7. A method according to claim 6, wherein the washing solution is kept in a temperature range of about 60° C. to 80° C.

8. A method according to claim 6, wherein a content of hydrogen peroxide in the washing solution is less than 1.0 wt. %.

9. A method according to claim 7, wherein a content of hydrogen peroxide in the washing solution is less than 1.0 wt. %.

* * * * *